US005821906A

United States Patent [19]

Campan

[11] Patent Number: 5,821,906

[45] Date of Patent: Oct. 13, 1998

[54] REAR FEED SOURCE FOR REFLECTOR ANTENNA

[75] Inventor: Yves Campan, Taverny, France

[73] Assignee: Thomson-CSF, Paris, France

[21] Appl. No.: 867,925

[22] Filed: Jun. 3, 1997

Related U.S. Application Data

[63] Continuation of Ser. No. 235,693, Apr. 29, 1994, abandoned.

[30] Foreign Application Priority Data

Apr. 30, 1993 [FR] France ..... 93 05144

[51] Int. Cl.[6] ..... H01Q 13/00

[52] U.S. Cl. ..... 343/786; 343/840; 343/781 R; 333/122

[58] Field of Search ..... 343/781 R, 786, 343/840; 333/239, 248, 122

[56] References Cited

U.S. PATENT DOCUMENTS

| | | | |
|---|---|---|---|
| 2,505,424 | 4/1950 | Moseley | 343/776 |
| 2,893,003 | 6/1959 | Arnold et al. | 343/781 R |
| 3,413,642 | 11/1968 | Cook | 343/781 |
| 3,883,877 | 5/1975 | Chabah et al. | 343/778 |
| 3,906,495 | 9/1975 | Roger | 343/7 A |
| 4,420,756 | 12/1983 | Hamada et al. | 333/122 |
| 4,574,289 | 3/1986 | Henderson | 343/786 |
| 4,922,213 | 5/1990 | Ghosh | 333/239 |
| 5,003,321 | 3/1991 | Smith et al. | 343/781 R |

FOREIGN PATENT DOCUMENTS

| | | | |
|---|---|---|---|
| 0422431A | 9/1990 | European Pat. Off. | 343/786 |
| 2 581 257 | 10/1986 | France . | |
| 0066140 | 6/1978 | Japan | 343/772 |
| 1092623 | 5/1984 | U.S.S.R. | 343/786 |
| 708614 | 5/1954 | United Kingdom . | |

OTHER PUBLICATIONS

Antenna Theory Analysis and Design, 1982, p. 587.

Microwave Journal, vol. 9, No. 2, Feb. 1966, Dedham US, pp. 50–54. A.C. Studd, "A Rear Feed For Paraboloidal Reflectors".

*Primary Examiner*—Hoanganh T. Le

*Assistant Examiner*—Tan Ho

*Attorney, Agent, or Firm*—Oblon, Spivak, McClelland, Maier & Neustadt, P.C.

[57] ABSTRACT

A rear feed source for a reflector antenna and an antenna using such a source. The source includes at least one horn connected to a waveguide. The horn has at least two inclined walls forming an aperture, each wall being extended by a wall with a different inclination. This invention can be applied to radars, notably surveillance radars.

10 Claims, 7 Drawing Sheets

REAR FEED SOURCE FOR REFLECTOR ANTENNA

This application is a Continuation of application Ser. No. 08/235,693, filed on Apr. 29, 1994, now abandoned.

BACKGROUND OF THE INVENTION

1. Field of the Invention

The present invention relates to a rear feed source for reflector antennas. It can be applied notably to elliptical antennas having a pattern that is narrow in terms of relative bearing and wide in terms of elevation, when applied to surveillance radars capable of carrying out measurements of angular distance in relative bearing. More generally, it can be applied to sources for rear feed antennas for which it is necessary to improve the pattern in the plane of the electrical field in limiting gain losses as well as the level of the side lobes.

2. Description of the Related Art

For reasons related to space requirement, it may be advantageous, in certain applications such as airborne radars for example, to use rear feed antennas. Moreover, in addition to these conditions of space requirement, there is generally the need to obtain antenna patterns of high quality and high directivity. This may be the case, for example, with a horizontally polarized maritime surveillance radar antenna that rotates about a vertical axis and has a wide pattern in elevation for monitoring and a narrow pattern in relative bearing for the measurements of angular distance. An antenna such as this then includes a reflector, illuminated by a rear feed source. This reflector is in the shape of a paraboloid cut off by a plane. The biggest dimension of the reflector is along the horizontal axis while its smallest dimension is along the vertical axis. To carry out functions of angular distance measurements, there are two types of monopulse rear feed sources. These are monopulse sources with polarization in the plane E of the electrical field and monopulse sources with polarization in the plane H of the magnetic field. Sources with polarization in the plane E use parallel waveguides. The two waveguides are excited, for example, by a magic-T junction folded in the plane E in a manner known to those skilled in the art. The sum and difference channels of the magic-T junction respectively propagate, on the one hand, in the TE01 mode and, on the other hand, in the TM11 and TE11 modes. The sources of polarization in the plane H use, for example, only one waveguide in which there are propagated the modes TE01 for the sum channel and TE02 for the difference channel. The sum and difference channels are, for example, excited by means of a magic-T junction in a manner known to those skilled in the art.

In relation to the above-mentioned application, the rear feed sources generally have several drawbacks. Primarily, the patterns defocus of an antenna illuminated by this type of source. This leads notably to high-level side lobes as well as to a loss of gain, resulting in reduced efficiency in the antenna.

SUMMARY OF THE INVENTION

The aim of the invention is to overcome the above-mentioned drawback, notably by making it possible to obtain rear feed antennas that perform well in terms of efficiency.

To this end, an object of the invention is a rear feed source for a reflector antenna constituted by at least one horn connected to a waveguide, the horn having at least two inclined walls forming an aperture, wherein each wall is extended by a wall with a different inclination so that the phase center of the radiation is inside the horn.

The main advantages of the invention are that it can be used to reduce the crossed polarization rate thus reducing energy losses, that it enables reducing the space requirement of the source, is appropriate for all types of reflectors, and is simple to implement and economical.

BRIEF DESCRIPTION OF THE DRAWINGS

Other features and advantages of the invention shall appear from the following description, which is made with reference to the appended drawings of which.

DESCRIPTION OF THE INVENTION

Figure 1:
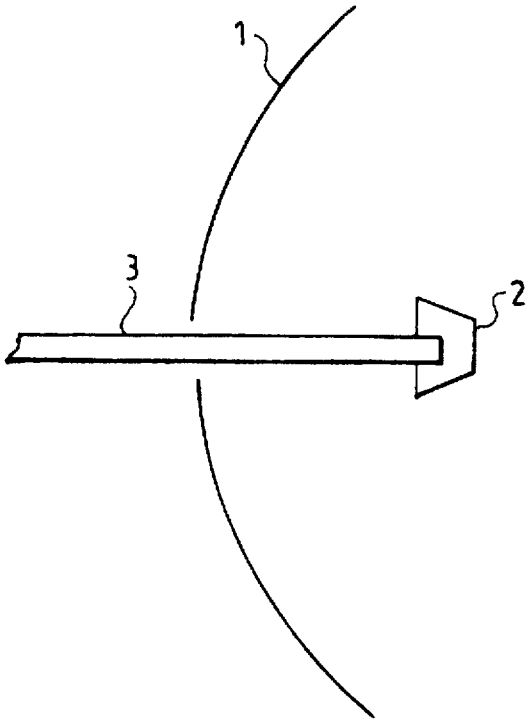
FIG. 1 is a diagram illustrating the principle of a reflector having a rear feed source.

FIG. 1 is a diagram illustrating the principle of an exemplary reflector antenna having a rear feed source. The antenna has a parabaloid-shaped reflector 1. This reflector 1 is illuminated by a rear feed source 2. The source 2 being connected to a waveguide 3 that goes through the reflector 1. The waveguide being itself connected to means for the generation of microwaves, notably at the output of a transmitter.

Figure 2:
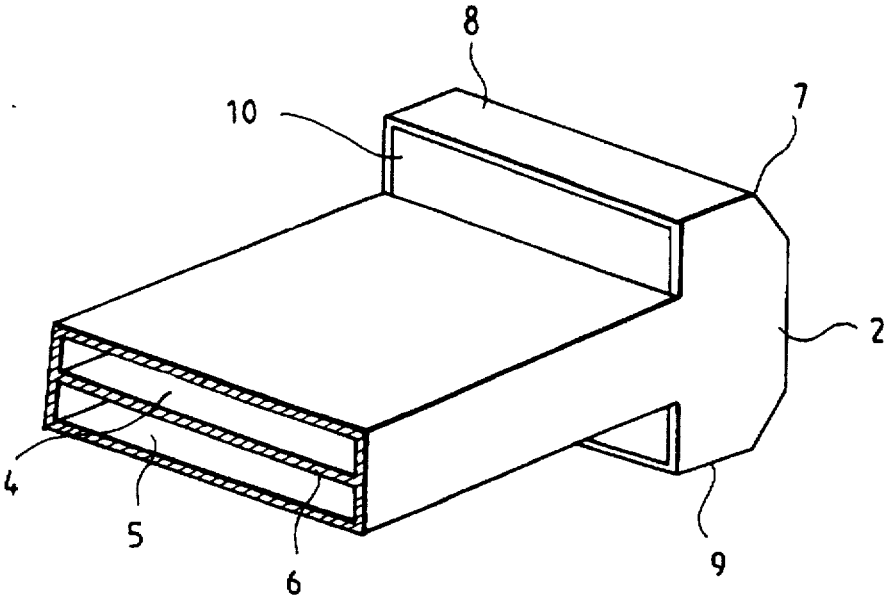
FIG.2 PRIOR ART
FIG. 2 shows an embodiment of a rear feed source according to the prior art.
Figure 4:
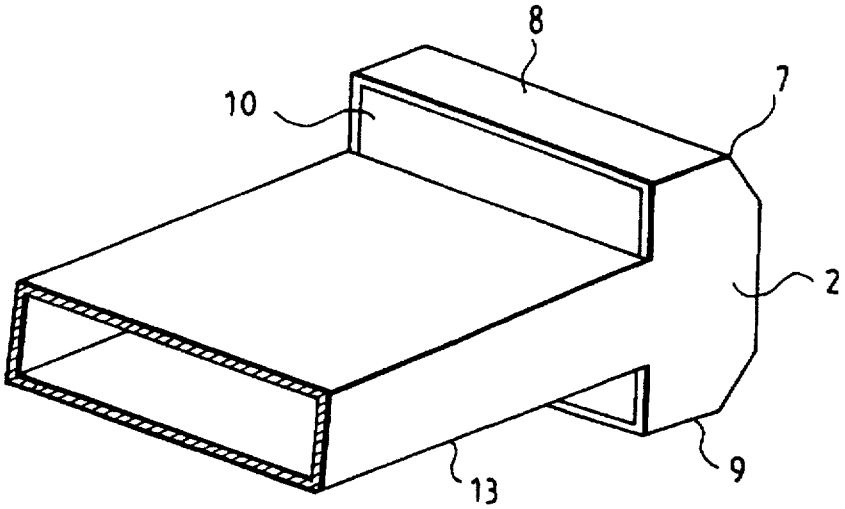
FIG.4 PRIOR ART
FIG. 4 shows another embodiment of a rear feed source according to the prior art.

FIGS. 2 and 4 show detailed views of possible embodiments of rear feed sources according to the prior art.

FIG. 2 shows notably the radiating part of a monopulse source 2 with polarization in the plane of the electrical field, connected to two waveguides 4, 5 separated by a metal wall 6.

Figure 3:
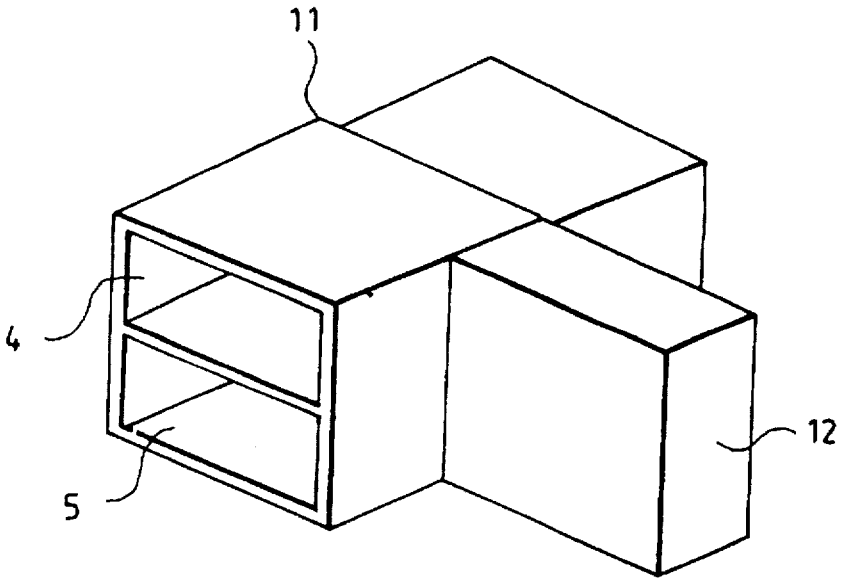
FIG. 3 shows a magic-T junction folded in the plane of the electrical field.

The two waveguides 4, 5 are excited, for example, by means of a magic-T junction folded in the plane of the electrical field E, (this magic-T junction being shown in FIG. 3). The waves that go through the two waveguides 4, 5, which are designed for the making of the sum pattern, get propagated according to the TE01 mode. The other output 12 of the magic-T junction 11, assigned to the difference channel, is crossed by a wave that gets propagated in the TM11 and TE11 modes added together.

The radiating part of the source 2 is constituted by at least one horn 7 terminated by two walls 8, 9 which are, for example, plane walls forming an aperture cut by an aperture plane 10 perpendicular to the direction of propagation of the wave going through the waveguides 4, 5. The horn 7 and the waveguides 4, 5 are positioned on either side of the aperture plane 10. This plane delimits the aperture of the horn 7, hence that of the source 2, the aperture being in a position of facing the reflector 1.

FIG. 4 shows a monopulse source with polarization in the magnetic plane H.

The radiating part of the source 2 has a horn 7 with a structure similar to that of the source shown in FIG. 2 but, in this case, the horn is connected to a single waveguide 13 propagating the TE01 mode designed for the sum channel and the TE02 mode designed for the difference channel. The sum and difference channels are excited by means of a magic-T junction folded in the plane of the magnetic field H.

Figure 5:
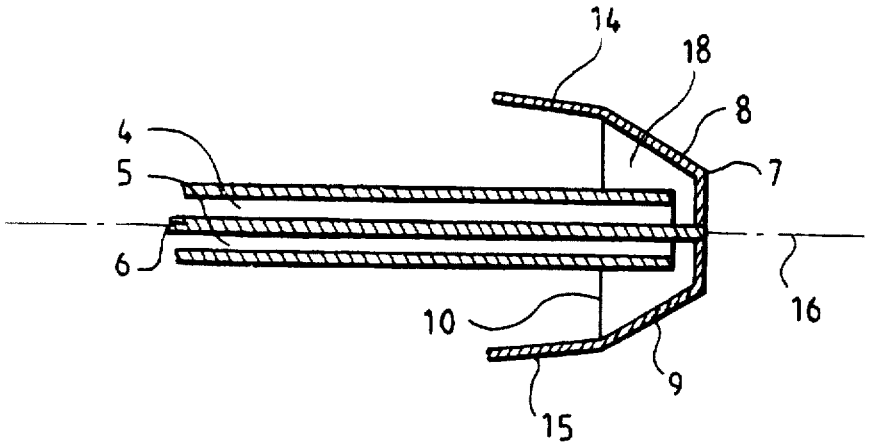
FIG. 5 shows a rear feed source according to the invention.

FIG. 5 shows a sectional view of an exemplary source according to the invention. The walls 8, 9 that terminate or end the horn 7, constituted by metallized walls, are each extended by a new metallic end wall 14, 15 having an inclination different from that of the preceding walls 8, 9. The new end walls 14, 15 being open and form, for example, a smaller angle with the median plane 16 of the horn 7. These new end walls are, for example, plane walls.

Figure 6:
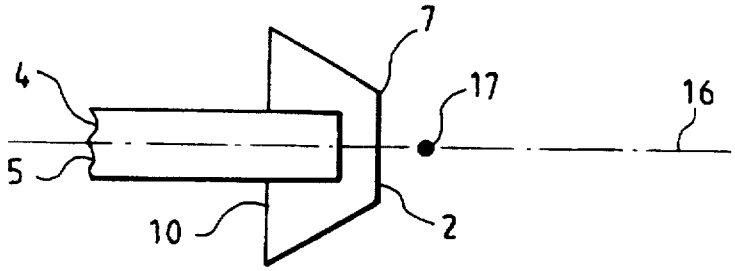
FIGS. 6 and 7 show illustrations of positions of phase centers with reference to a rear feed source.
Figure 7:
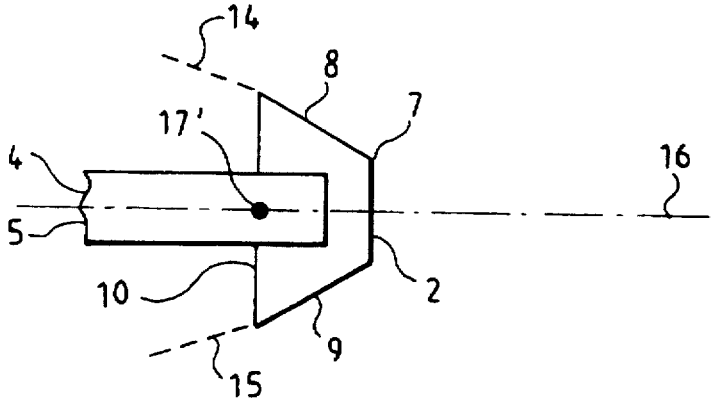

FIGS. 6 and 7 illustrate the effect of adding on new end walls 14, 15.

FIG. 6 shows a known result, namely a case in which the phase center 17 of the radiation produced by the horn 7 in the plane of the electrical field E is located behind the source 2, at a distance that is generally equal to 0.3 wavelengths. This position of the phase center is expressed by a defocusing of the patterns of an antenna illuminated by a rear feed illumination source of this kind. This gives rise notably to a high rate of side lobes as well as to a loss of gain, which means lower efficiency of the antenna.

The experiments carried out by the Applicant have shown that by adding on the new end walls 14, 15 to the horn 7 of the source 2, the phase center 17 could then be positioned inside the source, this new phase center 17' being then located, for example, in the former aperture plane 10 as illustrated in FIG. 7. The position of the new phase center 17' is, for example, obtained notably by modulating either the length of the new end walls 14, 15 or their inclination. Since the phase center is located inside the source, the above-mentioned defocusing is then practically eliminated.

The source of FIG. 5 is a monopulse rear feed source with polarization in the plane of the electrical field E, connected to two waveguides in accordance with the example of FIG. 1. The wall 6 for the separation of the two waveguides 4, 5 is connected to the rear wall of the horn 7.

Figure 8:
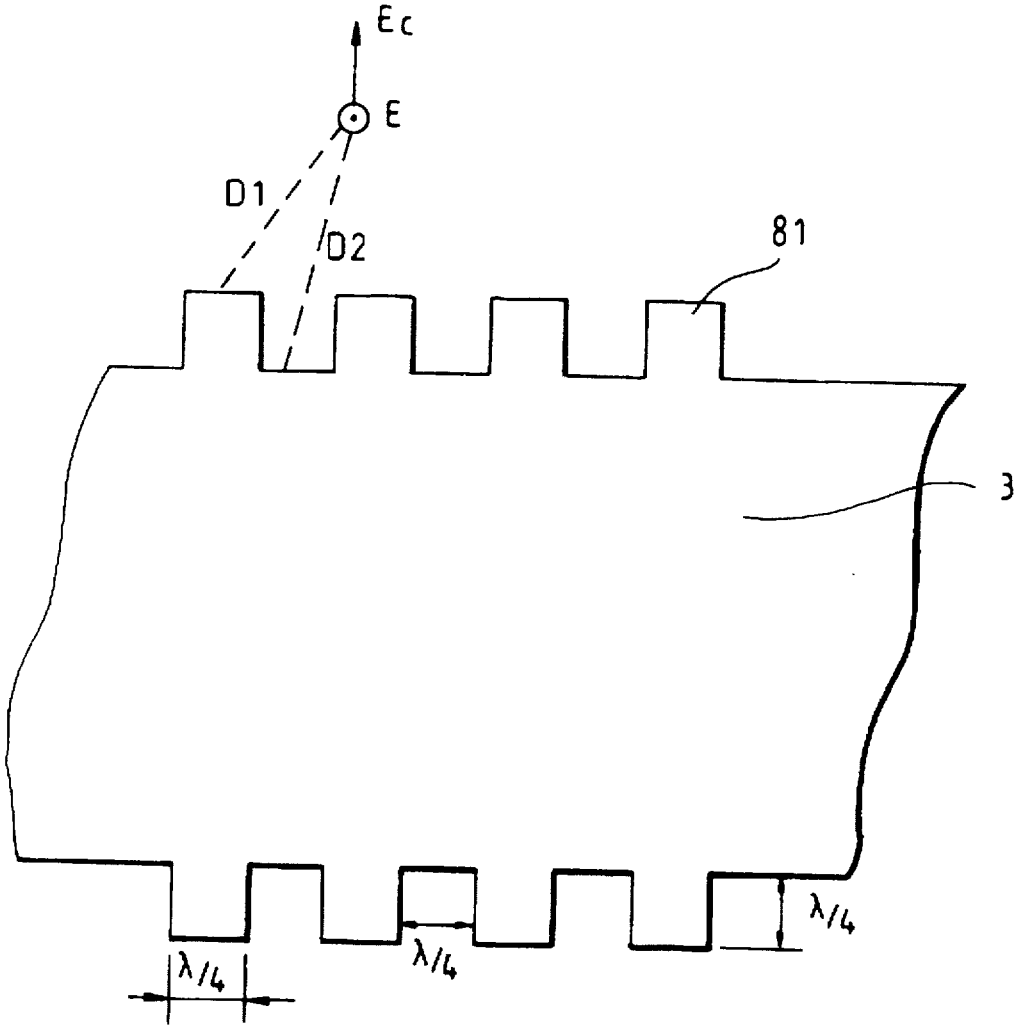
FIG. 8 shows a possible embodiment of a waveguide used in a source according to the invention.

FIG. 8 shows a top view of a possible embodiment of the waveguide 3 connected to the source 2. This waveguide may have, for example, one of the waveguide structures 4, 5, 13 illustrated by FIGS. 2 or 4. This embodiment makes it possible notably to reduce the crossed polarization rate and hence to reduce energy losses. With the waveguide 3 having a rectangular structure, FIG. 8 shows a view of one of the two large sides of the waveguide. The edges of this side, made of metal, are constituted by indentations 81. The edges of the opposite side too are constituted by indentations. The width of the indentations is equal, for example, to $\lambda/4$, $\lambda/4$ being the wavelength transmitted by the waveguide. The depth of the indentations is also, for example, equal to $\lambda/4$ as is the distance between each indentation. Since the electrical field E gets propagated along the waveguide and since its direction is perpendicular to the large sides of this waveguide, the direction of the field Ec due to the crossed polarization is then located in the plane of the large sides, this field Ec getting propagated along the waveguide. The indentations 81 prevent the propagation of the crossed polarization field Ec. Indeed, at an instant t, since this field Ec is at a distance D1 from any indentation and at a distance D2 from the neighboring edge of the waveguide, the field Ec has one component radiated by the indentation and one component radiated by the edge of the waveguide. If the lengths of the indentations as well as the intervals between them are substantially equal to $\lambda/4$ as indicated here above, then the difference between the above-mentioned distances D1, D2 is substantially equal to $\lambda/2$. The result thereof is that the above-mentioned indentation and edge of the waveguide radiate field components in phase opposition at the point at which the polarization field Ec is computed, which tends to cancel out this field Ec. The indentations and the intervals between the indentations therefore respectively create elementary radiation, the elementary radiation created by the indentations being in a state of phase opposition with respect to the elementary radiation created by the intervals between the indentations.

Figure 9:
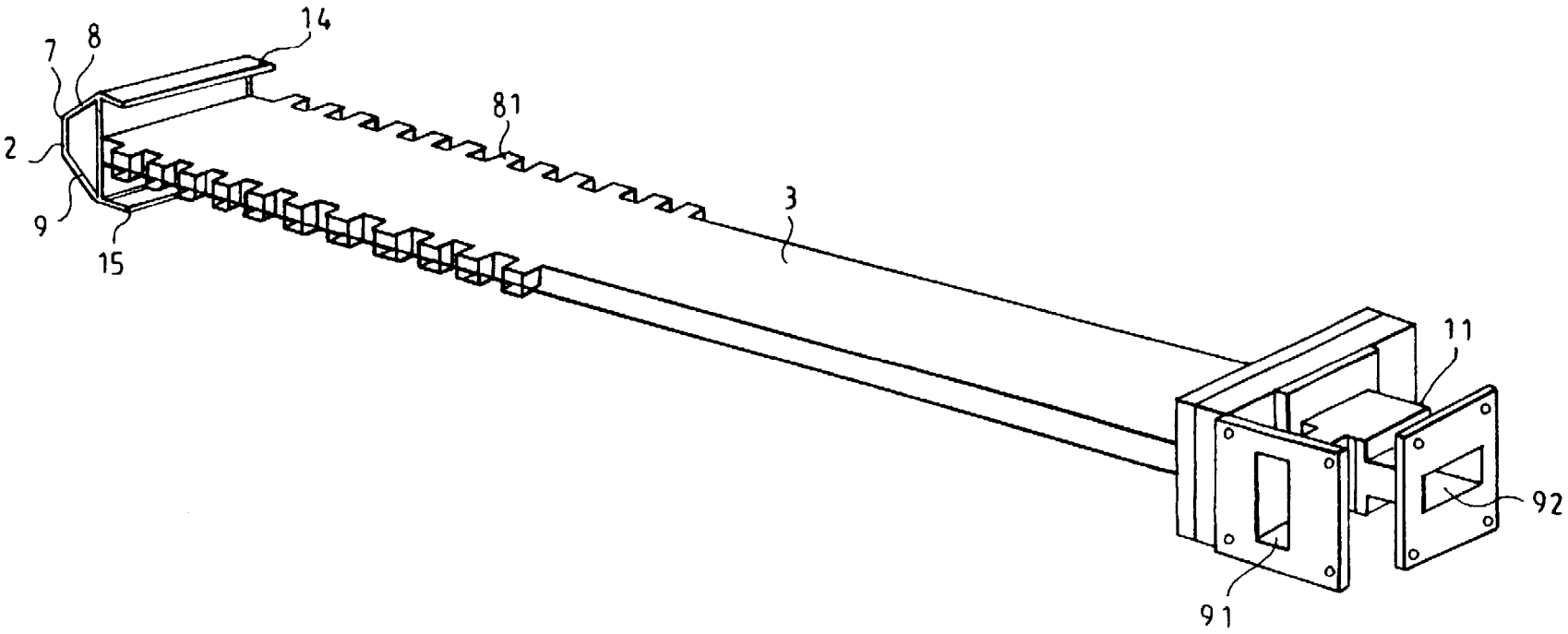
FIG. 9 shows a source according to the invention using a waveguide of the above-mentioned mode.

FIG. 9 shows a possible embodiment of a source 2 according to the invention, the radiating part being connected to a waveguide provided with indentations 81, the waveguide being connected furthermore to a magic-T junction 11. The source notably comprises a horn 7 with walls 14, 15 that extend walls 8, 9 with a different inclination. The waveguide 3, which belongs to the type of waveguide 4, 5, 13 shown in FIGS. 2 or 4, in the case of a monopulse antenna application for example, has indentations 81 on the edges of its large sides. The indentations have a width and a depth that is equal, for example, to a quarter of the wavelength transmitted. The length of the intervals between the indentations is also equal, for example, to a quarter of the wavelength. The magic-T junction 11 is, for example, a magic-T junction folded in the plane E, with an input 91 that is assigned, for example, to a difference channel and with an input 92 that is assigned, for example, to a sum channel.

The above-mentioned embodiment, illustrated by FIG. 9, can be notably improved by changing the relationship of illumination at the aperture of the horn, this being achieved through the creation, for example, of a discontinuity inside the waveguide 3.

Figure 10A:
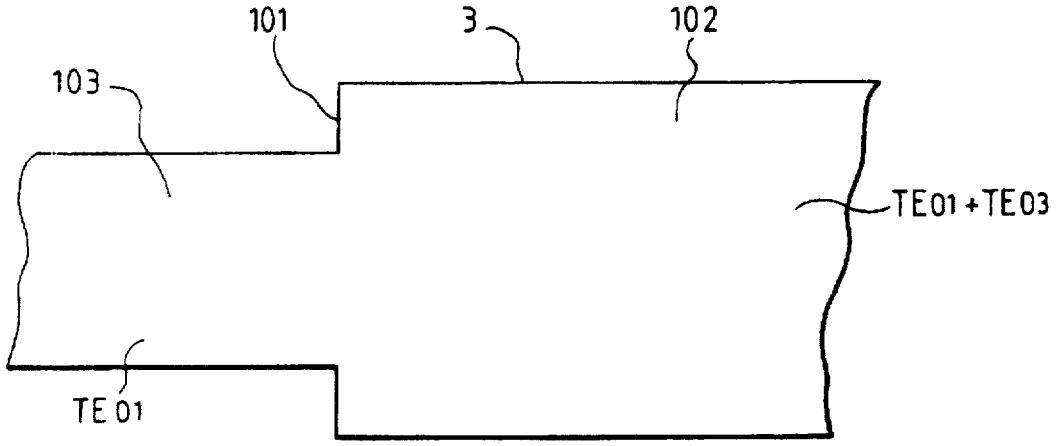
FIG. 10*a*–10*e* show another possible embodiment of a waveguide used in a source according to the invention.

FIG. 10*a* shows an exemplary embodiment of the waveguide that can be used to attain a goal such as this, making it possible to notably reduce the space requirement of an antenna that uses a source according to the invention, as well as its weight. To this end, the waveguide 3 has a discontinuity of width referenced 101, namely a place where the width of its large sides changes. This enables the excitation of a second mode in the wider part 102 of the waveguide, from a first mode excited in the narrower part 103 of the waveguide, the two modes getting added together in the wider part 102.

Figure 10B:
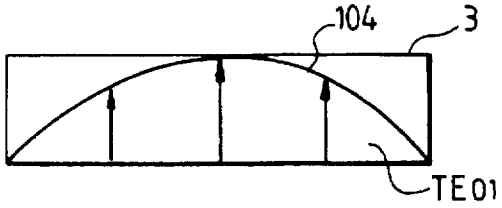
Figure 10C:
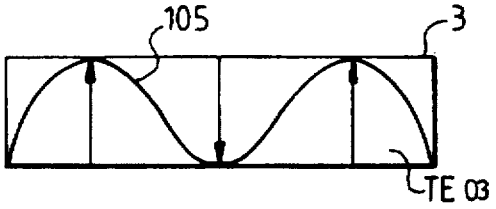
Figure 10D:
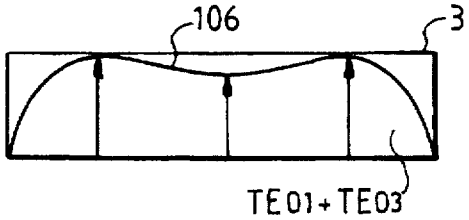

FIGS. 10*b*, 10*c* and 10*d* show sectional views of the waveguide 3 with the respective representations of the TE01, TE03 mode and the addition of the above-mentioned two modes TE01+TE03.

FIG. 10*b* illustrates the amplitude 104 of the electrical field in the section of the waveguide 3 in relation to the TE01 mode. This first mode is excited in the narrow part 103 of the waveguide. The discontinuity 101 generates the excitation of the TE03 mode illustrated by FIG. 10*c*, a curve 105 in this FIG. 10*c* representing the amplitude of the TE03 mode. These two known modes get added up in the wide part 102 of the waveguide since the TE01 mode continues to get propagated therein.

In FIG. 10*d*, a curve 106 illustrates the addition of the TE01 and TE03 modes. This mode actually creates a new mode TE01+TE03 that is propagated in the wide part 102 of the waveguide, (this wide part 102 of the waveguide being connected to the source according to the invention).

Figure 10E:
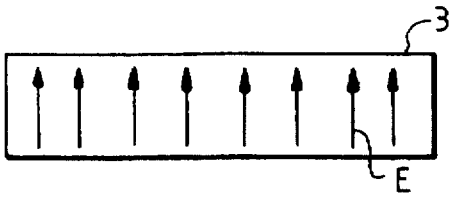

FIG. 10*d* shows that the amplitude of the field represented by the curve 106 inside the waveguide is close to the uniformity illustrated by FIG. 10*e*, where the amplitude of the electrical field E is uniform throughout the section of the waveguide. The electrical field is therefore close to uniformity at the aperture of the horn 7 of the source. This makes it possible notably to obtain a source pattern having greater directivity. The directivity is generally related to the dimension of the source. In the above-mentioned exemplary embodiment, the performance values obtained in terms of the uniformity of the electrical field at output of the source make it possible, for a given directivity, to reduce the size of the source as well as that of the waveguide to which it is connected, and hence provides gains in terms of space requirement and weight.

The waveguide used in the source according to the invention may possess, for example, the discontinuity 101 as well as the above-mentioned indentations 81.

Figure 11:
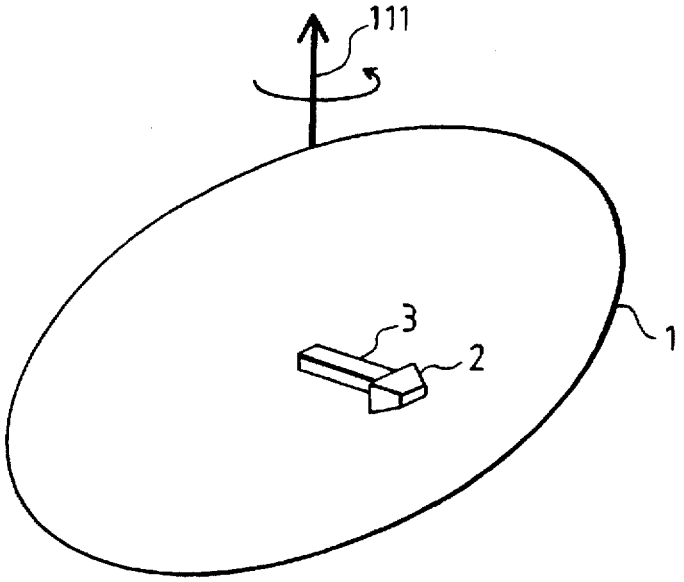
FIG. 11 shows an exemplary application of a source according to the invention.

FIG. 11 shows an exemplary view of an application of a source according to the invention for a horizontally polarized maritime surveillance radar. The reflector 1 rotates about a vertical axis 111. The reflector 1 is cut out into a parabaloid that is highly flattened, in the vertical direction, so as to obtain, for example, a pattern that is narrow in relative bearing and wide in elevation. The source 2 and the waveguide 3 that supply it are structured, for example, in accordance with the embodiment of FIG. 9. Furthermore, the waveguide 3 has, for example, a discontinuity of the type shown in FIG. 10*a* in order to improve the directivity of the source.

What is claimed is:

1. A rear feed source for a reflector antenna constituted by at least one horn connected to a waveguide, the horn having at least two inclined walls, which form a first angle to a longitudinal direction of said waveguide, forming an aperture, wherein each wall is extended by a wall with a second angle of inclination to said longitudinal direction of said waveguide, which is smaller than the first angle so that the phase center of the radiation is located inside the horn.

2. A source according to claim 1, wherein the walls are plane walls.

3. A source according to claim 1 wherein, with the waveguide having a rectangular section, the edges of its large sides are constituted by indentations.

4. A source according to claim 3, wherein the length and depth of the indentations are substantially equal to a quarter of the wavelength ($\lambda/4$) that gets propagated in the waveguide, the interval between two successive indentations being substantially equal to a quarter of this wavelength ($\lambda/4$).

5. A source according to claim 1 wherein, with the waveguide having a rectangular internal section, it has a discontinuity that consists of a modification of the width of its large sides.

6. A source according to claim 5 wherein, in the part of the waveguide having the smallest width, the TE01 mode is excited, the part of the waveguide having the greatest width being connected to the horn.

7. A source according to claim 1, wherein the waveguide is constituted by two waveguides separated by a metal wall connected to the horn.

8. A source according to claim 1, wherein the waveguide is connected at its other end to a magic-T junction folded in the plane of polarization of the electrical field.

9. A rear feed source forming a horn covering an end of a wave guide for projecting a wave carried by the wave guide, comprising:

an end of the horn adjacent the end of the wave guide where the wave is output;

a first wall extending from the end of the horn to a point over the wave guide at a first angle of inclination to a longitudinal direction of said waveguide;

a second wall extending from the first wall at a second angle of inclination to said longitudinal direction of said waveguide which is smaller than said first angle, further enveloping the wave guide; and wherein, a phase center of the wave is caused to be located within the horn and a projected patter of the wave is focused.

10. A rear feed source for a reflector antenna comprising:

a waveguide having a rectilinear cross-section and extending in a longitudinal direction;

a horn including an end wall perpendicular to the longitudinal direction and spaced from the waveguide in the longitudinal direction, two inclined walls extending from the ends of the end wall and forming an angle with the longitudinal direction, and side walls extending between the inclined walls and extending in the longitudinal direction from the end wall to a point beyond the end of the waveguide, thus forming an aperture plane perpendicular to the longitudinal direction; and extended walls extending from the ends of said inclined walls, said extended walls forming an angle with the longitudinal direction which is smaller than the angle formed between the longitudinal direction and inclined walls;

a phase center of the horn being located within the horn.

* * * * *